US009897936B2

(12) United States Patent
Natori et al.

(10) Patent No.: US 9,897,936 B2
(45) Date of Patent: Feb. 20, 2018

(54) METHOD OF PRODUCING CURABLE LIQUID DEVELOPER AND CURABLE LIQUID DEVELOPER

(71) Applicant: CANON KABUSHIKI KAISHA, Tokyo (JP)

(72) Inventors: Ryo Natori, Tokyo (JP); Waka Hasegawa, Tokyo (JP); Ayano Mashida, Kawasaki (JP); Junji Ito, Hiratsuka (JP); Yasuhiro Aichi, Tokyo (JP); Jun Shirakawa, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/166,633

(22) Filed: May 27, 2016

(65) Prior Publication Data

US 2016/0349652 A1 Dec. 1, 2016

(30) Foreign Application Priority Data

May 27, 2015 (JP) ..... 2015-107396

(51) Int. Cl.

| | |
|---|---|
| ***G03G 9/08*** | (2006.01) |
| ***G03G 9/13*** | (2006.01) |
| ***G03G 9/087*** | (2006.01) |
| *G03G 15/10* | (2006.01) |

(52) U.S. Cl.
CPC ..... *G03G 9/131* (2013.01); *G03G 9/08755* (2013.01); *G03G 15/10* (2013.01)

(58) Field of Classification Search
CPC ..... G03G 9/0804
See application file for complete search history.

(56) References Cited

U.S. PATENT DOCUMENTS

| | | | | |
|---|---|---|---|---|
| 4,837,102 | A * | 6/1989 | Dan | G03G 9/131 430/114 |
| 5,106,716 | A * | 4/1992 | Kato | G03G 9/131 430/114 |
| 5,364,726 | A | 11/1994 | Morrison et al. | |
| 5,459,007 | A * | 10/1995 | Larson | G03G 9/122 430/115 |
| 7,833,687 | B2 | 11/2010 | Kato et al. | |
| 8,697,327 | B2 | 4/2014 | Shibata et al. | |
| 8,722,302 | B2 | 5/2014 | Maeda et al. | |
| 8,815,484 | B2 | 8/2014 | Tanaka et al. | |
| 9,057,970 | B2 | 6/2015 | Ida et al. | |
| 9,229,345 | B2 | 1/2016 | Ikeda et al. | |
| 9,348,247 | B2 | 5/2016 | Ida et al. | |
| 2004/0021753 | A1 | 2/2004 | Yoshihiro et al. | |
| 2010/0055602 | A1 | 3/2010 | Teshima | |
| 2014/0356779 | A1 | 12/2014 | Hasegawa et al. | |
| 2014/0377697 | A1 | 12/2014 | Nishiura et al. | |
| 2015/0004539 | A1 | 1/2015 | Watanabe et al. | |
| 2015/0192875 | A1 | 7/2015 | Ito et al. | |
| 2015/0274853 | A1 | 10/2015 | Nishiura et al. | |
| 2015/0277254 | A1 | 10/2015 | Mukumoto et al. | |

FOREIGN PATENT DOCUMENTS

| | | | |
|---|---|---|---|
| JP | 0626078 | A | 8/1994 |
| JP | 2002012607 | A | 1/2002 |
| JP | 2002188025 | A | 7/2002 |
| JP | 2003026978 | A | 1/2003 |
| JP | 3442406 | B2 | 9/2003 |
| JP | 2003342503 | A | 12/2003 |
| JP | 2010060849 | A | 3/2010 |
| JP | 5148621 | B2 | 2/2013 |
| JP | 5277800 | B2 | 8/2013 |

OTHER PUBLICATIONS

Y. Harasaki, "Coating Basics and Engineering", Converting Technical Institute, p. 53, Table 3.9.
S. Ito, "Dictionary of Pigments", pp. 345-349, Main text and Figs. II.4.73-II.4.75.
S. Ito, "Dictionary of Pigments", pp. 345-349, Main text and Figs. II.3.73-II.4.75.
W. Herbst, et al., "Industrial Organic Pigments", List of Commercially Available Pigments, pp. 637-645.

* cited by examiner

*Primary Examiner* — Hoa V Le
(74) *Attorney, Agent, or Firm* — Fitzpatrick Cella Harper and Scinto

(57) ABSTRACT

A curable liquid developer production method that can efficiently produce a curable liquid developer is provided. A curable liquid developer is also provided. The method is a method of producing a curable liquid developer containing a pigment, a binder resin, a toner particle dispersing agent, and a curable insulating liquid, this method including: a pigment dispersion step of preparing a pigment dispersion containing a pigment, a binder resin, a toner particle dispersing agent, and a solvent; a mixing step of mixing the pigment dispersion with a curable insulating liquid; and a distillative removal step of distillatively removing the solvent from a mixture obtained in the mixing step.

12 Claims, 1 Drawing Sheet

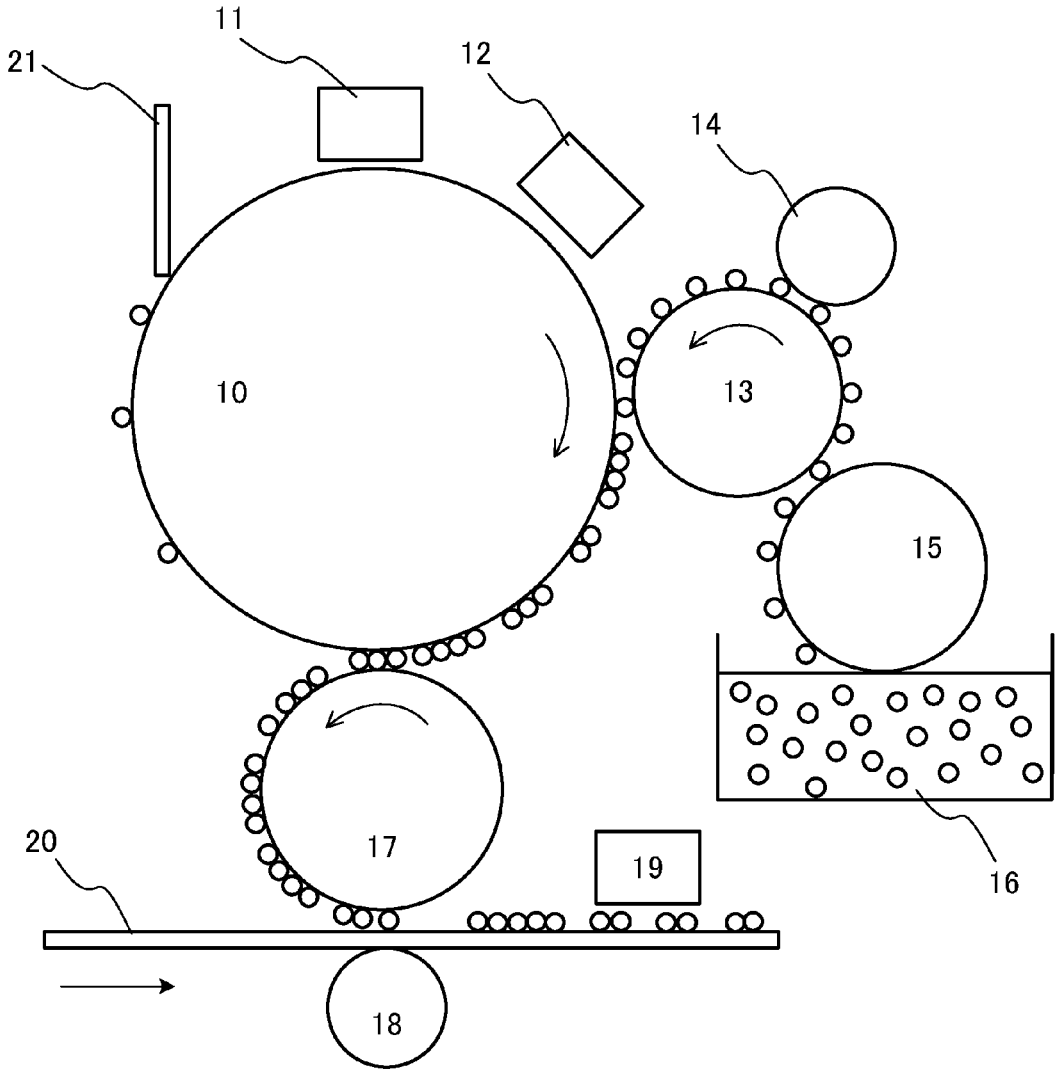
11
12
21
14
10
13
15
16
17
19
20
18

METHOD OF PRODUCING CURABLE LIQUID DEVELOPER AND CURABLE LIQUID DEVELOPER

BACKGROUND OF THE INVENTION

Field of the Invention

The present invention relates to a method of producing a liquid developer for use in image-forming apparatuses that utilize an electrophotographic system, e.g., electrophotography, electrostatic recording, and electrostatic printing. The present invention also relates to the liquid developer produced by this production method.

Description of the Related Art

The need for color capabilities in image-forming apparatuses that utilize electrophotographic systems, for example, copiers, facsimile machines, and printers, has been on the increase in recent years. Within this context, the development is being actively pursued of high image-quality high-speed digital printers that utilize electrophotographic technologies that use liquid developers, which have an excellent reproducibility for fine line images, an excellent gradation reproducibility, and an excellent color reproducibility and which are excellent for high-speed image formation. Given these circumstances, the development is required of liquid developers having better properties.

A dispersion of colored resin particles in an insulating liquid, e.g., a hydrocarbon organic solvent or silicone oil, is already known as a liquid developer. However, when, in the case of such a liquid developer, the insulating liquid remains present on the recording medium, e.g., paper or plastic film, this ends up causing a substantial deterioration in the appearance of the image, and due to this the insulating liquid must be removed. In a method generally used to remove the insulating liquid, thermal energy is applied to volatilize and remove the insulating liquid; however, this is not necessarily preferred from an environmental perspective, for example, a vapor of the volatile organic solvent ends up being emitted from the apparatus and large amounts of energy are consumed.

A method in which the cure of a reactive functional group-bearing insulating liquid (Japanese Patent No. 3,442,406) is brought about has been disclosed as a countermeasure to the preceding. This method, which uses a reactive functional group-bearing monomer or oligomer as a curable insulating liquid, can form images using less energy than thermal fixing systems, which require the volatilization and removal of the insulating liquid through the application of thermal energy. Methods based on wet pulverization methods have been disclosed as methods for producing this liquid developer. However, these methods have required the execution of a time-consuming wet pulverization treatment in order to reach the desired particle diameter and have been encumbered by the problems of requiring long periods of time for production and of a substantial reduction in the production efficiency.

A method of producing a curable liquid developer using a chemical procedure (Japanese Patent No. 5,277,800) has also been disclosed. However, this method requires substitution to the insulating liquid by drying the particles after toner particle formation has been carried out in water on an interim basis, and due to this the number of steps in the production process has been increased and the use of large amounts of energy has been required for production and this method has been encumbered by a substantial reduction in the production efficiency.

SUMMARY OF THE INVENTION

The present invention was pursued in view of these circumstances and takes as an object the introduction of a method of producing a curable liquid developer that can efficiently produce a curable liquid developer for use in an image-forming system in which a liquid developer is caused to cure on a recording carrier. A further object of the present invention is to provide a curable liquid developer.

The present invention is a method of producing a curable liquid developer comprising a pigment, a binder resin, a toner particle dispersing agent, and a curable insulating liquid, wherein the method includes: a pigment dispersion step of preparing a pigment dispersion comprising the pigment, the binder resin, the toner particle dispersing agent, and a solvent; a mixing step of mixing the pigment dispersion with the curable insulating liquid; and a distillative removal step of distillatively removing the solvent from a mixture obtained in the mixing step.

The curable insulating liquid in the present invention preferably contains a vinyl ether compound and the binder resin in the present invention preferably contains a polyester resin.

In addition, the vinyl ether compound in the present invention preferably is represented by the following general formula (1)

$$(H_2C{=}CH{-}O{-})_n R \qquad (1)$$

[In formula (1), n is an integer from 1 to 4 and R is an n-valent hydrocarbon group.].

The polyester resin in the present invention preferably has a unit represented by the following general formula (2)

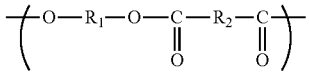

(2)

[In formula (2), at least one of $R_1$ and $R_2$ has an aromatic ring.].

In addition, the SP value of the vinyl ether compound in the present invention preferably is not more than 8.5, and a difference between the SP value of the binder resin and the SP value of the curable insulating liquid preferably is at least 2.6 in the present invention.

In the present invention, phase separation of the binder resin is preferably brought about in the mixing step.

A weight-average molecular weight of the polyester resin also is preferably at least 5,000 and not more than 30,000 in the present invention, and an acid value of the polyester resin is preferably at least 5 mg KOH/g in the present invention.

A curable liquid developer for use in image-forming systems in which a liquid developer is cured on a recording carrier, can be rapidly produced according to the present production method in a small number of steps, i.e., can be efficiently produced.

Further features of the present invention will become apparent from the following description of exemplary embodiments (with reference to the attached drawings).

BRIEF DESCRIPTION OF THE DRAWINGS

FIG. 1 contains an example of an image-forming apparatus that uses a curable liquid developer.

DESCRIPTION OF THE EMBODIMENTS

The method of the present invention for producing a liquid developer characteristically has a pigment dispersion step of preparing a pigment dispersion that contains a pigment, a binder resin, a toner particle dispersing agent, and a solvent; a mixing step of mixing the pigment dispersion with a curable insulating liquid; and a distillative removal step of distillatively removing the solvent from the mixture obtained in the mixing step.

As a result of various investigations into methods for producing curable liquid developers, the present inventors focused on the idea of the binder resin being precipitatable by the curable insulating liquid. They also discovered that a desirable particle formation is made possible by the addition, while applying shear force, of a curable insulating liquid to a pigment dispersion containing a pigment, binder resin, toner particle dispersing agent, and solvent with the binder resin being in a dissolved state. A desirable particle formation is possible according to the present method without the later addition of the curable insulating liquid and without having to replace the liquid used during granulation with the curable insulating liquid, and due to this a curable liquid developer can be produced in a short period of time using a small number of steps.

As a result of various investigations from the standpoint of further improving the properties of curable liquid developers, that is, from the standpoint of the co-existence of three features, i.e., the granulating properties, insulating properties, and curability, the present inventors discovered that a vinyl ether compound is preferably used as the curable insulating liquid and a polyester resin is preferably used as the binder resin. In general, acrylic compounds are frequently selected for the curable insulating liquid in view of the wide variety of types, their cost, and their availability. However, compared to acrylic compounds, vinyl ether compounds tend to have a higher electrical resistance due to a lower polarity by the polymerizable functional group.

Moreover, while the details are unclear, it was discovered that toner particle sphericization and a small toner particle diameter are promoted in the production method of the present invention by establishing a large difference between the SP value of the binder resin and the SP value of the curable insulating liquid. A preferred combination here is the combination of a vinyl ether compound, which is a curable insulating liquid, with a polyester resin, which is a binder resin that has a low solubility in vinyl ether compounds. It is thought that the promotion of toner particle sphericization and a small toner particle diameter results in a small viscosity change as the liquid developer traverses the image-forming process and makes possible viscosity control of the liquid developer during image formation and a thinning of layered toner particles and due to this improves the transferability.

As a result of further investigations from this perspective, the present inventors discovered that the vinyl ether compound is preferably represented by the aforementioned general formula (1), the polyester resin is preferably represented by the aforementioned general formula (2), the difference between the SP value of the binder resin and the SP value of the curable insulating liquid is preferably at least 2.6, the weight-average molecular weight of the polyester resin is preferably at least 5,000 and not more than 30,000, and a polyester with an acid value of at least 5 mg KOH/g is preferably incorporated.

[The Pigment Dispersion Step]

A pigment dispersion containing a pigment, binder resin, toner particle dispersing agent, and solvent is prepared in the pigment dispersion step of the present invention. Viewed from the standpoint of establishing an excellent pigment dispersibility in the obtained toner particle, a pigment dispersing agent is preferably incorporated in the pigment dispersion. Substances that provide an excellent state of pigment dispersion in the pigment dispersion are advantageously used as the pigment dispersing agent.

The method of preparing the pigment dispersion can be exemplified by methods in which heating and dispersion of the pigment and binder resin are carried out on a heated three-roll mill to obtain a resin/pigment dispersion and the resin/pigment dispersion is subsequently dissolved in a solvent to obtain a pigment dispersion. Another example is a method in which the pigment, pigment dispersing agent, and solvent are mixed; a wet dispersion of the pigment is then brought about using a media-based dispersing apparatus, e.g., an attritor, ball mill, or sand mill, or a non-media dispersing apparatus, e.g., a high-speed mixer or high-speed homogenizer; and a resin solution, prepared by the dissolution of the binder resin in a solvent, is then added to obtain the pigment dispersion.

The content of the binder resin relative to the solvent, expressed per 100 mass parts of the solvent, is preferably 5 to 150 mass parts and more preferably 10 to 75 mass parts. Having the amount of binder resin be in the indicated range provides an excellent productivity and facilitates the formation of a desirable toner shape.

The content of the binder resin relative to the pigment, expressed per 1 mass parts of the pigment, is preferably 1 to 20 mass parts and more preferably 3 to 10 mass parts. Having the amount of pigment be in the indicated range facilitates the formation of high-density images and facilitates the formation of a desirable toner shape.

[The Mixing Step]

The pigment dispersion obtained in the pigment dispersion step is mixed with a curable insulating liquid in the mixing step of the present invention. Preferably the curable insulating liquid is added to the pigment dispersion. Phase separation of the binder resin is induced by mixing the pigment dispersion and a curable insulating liquid that does not dissolve the binder resin.

Phase separation of the binder resin is preferably brought about in this mixing step in the mixing step of the present invention. Due to this, the curable insulating liquid is preferably mixed in this mixing step in an amount at which the binder resin undergoes phase separation. In the present invention, the phase separation of the binder resin indicates a state in which particle formation can be confirmed when the curable insulating liquid has been mixed with the pigment dispersion provided by the dissolution of the binder resin, pigment, and toner particle dispersing agent in a solvent.

The early phase separation of the binder resin at the mixing step makes possible the formation of particles with a small particle diameter and a high circularity because the shear can then be delivered in a state in which there is a favorable viscosity ratio for the two phases in the phase-separated state and also because the toner particle dispersing agent can then favorably contribute to particle formation.

A high shear force is preferably applied in the mixing step of the present invention at the time of mixing the curable insulating liquid into the pigment dispersion. The shear force should be established as appropriate in conformity with the desired particle diameter. A high speed stirring-type dispersing apparatus, which exerts a stirring shear and can be exemplified by homogenizers and homomixers, can uniformly apply a high shear force to toner particles and is therefore preferred as a high-speed shear apparatus capable of applying a high shear force. In addition, various apparatuses are available with regard to capacity, rotation rate, model, and so forth, and an appropriate apparatus should be used in correspondence to the production regime. With regard to the rotation rate when a homogenizer is used, at least 500 rpm and not more than 30,000 rpm is preferred and at least 13,000 rpm and not more than 28,000 is more preferred.

The temperature in the mixing step is preferably at least as high the freezing point and not more than the boiling point of the solvent and curable insulating liquid. The range of 0 to 60° C. is specifically preferred.

[The Distillative Removal Step]

In the distillative removal step of the present invention, the solvent is distilled off from the liquid mixture obtained in the mixing step. A method such as evaporation is suitably used for the distillative removal method. With regard to the conditions, distillative removal at 0 to 60° C. at a reduced pressure corresponding to a pressure of 1 to 200 kPa is preferred.

[The Liquid Developer Preparation Step]

The present invention may have a liquid developer preparation step after the distillative removal step. An ultraviolet-curable liquid developer can be prepared in the liquid developer preparation step by the addition, to the toner particle dispersion obtained in the distillative removal step, of a photopolymerization initiator, charge control agent, additives, and so forth. The method of adding the photopolymerization initiator and additives is not particularly limited, but a suitable stirring with the application of heat is a possibility depending on the additive type.

A polymerizable liquid monomer may also be added in the liquid developer preparation step. The polymerizable liquid monomers used as curable insulating liquids can be used as this polymerizable liquid monomer.

This step may as appropriate also incorporate a unit process such as toner particle washing.

[The Toner Particle]

The toner particle contains a binder resin and a colorant as constituent components. A spherical toner particle having a small particle diameter can be produced by the production method of the present invention. A preferred average particle diameter for the toner particle is 0.05 to 5 μm and a more preferred average particle diameter is 0.1 to 2 μm. A preferred average circularity for the toner particle is the range from 0.948 to 1.000 and a more preferred average circularity is 0.970 to 1.000.

By having the average particle diameter of the toner particle be a value in the indicated range, the resolution of the toner image formed by the liquid developer can then be brought to a satisfactorily high level and the film thickness of the toner image can be made satisfactorily thin even for recording systems in which the carrier remains on the recording medium. In this Specification, the "average particle diameter" indicates the average particle diameter on a volume basis.

By having the average circularity of the toner particle be a value in the indicated range, a satisfactory transferability can also be ensured in those instances where an electrostatic transfer is required in the process of image formation on the recording medium.

The toner particle content in the curable liquid developer in the present invention is preferably 1 to 70 mass % and is more preferably 2 to 50 mass %.

The materials used in the present invention are described in the following.

[Pigment]

There are no particular limitations on the pigment, and for example, any generally commercially available organic pigment and inorganic pigment can be used; or a dispersion of a pigment in, for example, an insoluble resin as the dispersion medium can be used; or a pigment having a resin grafted to its surface can be used.

These pigments can be exemplified by the pigments described in "Dictionary of Pigments" (published 2000), compiled by Seishiro Ito; "Industrial Organic Pigments", W. Herbst and K. Hunger; Japanese Patent Application Laid-open Nos. 2002-12607, 2002-188025, 2003-26978 and 2003-342503.

The following are specific examples of organic pigments and inorganic pigments that present a yellow color and can be used in the present invention: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

Pigments that present a red or magenta color can be exemplified by the following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C. I. Pigment Violet 19; and C. I. Vat Red 1, 2, 10, 13, 15, 23, 29, and 35.

Pigments that present a blue or cyan color can be exemplified by the following: C. I. Pigment Blue 2, 3, 15:2, 15:3, 15:4, 16, and 17; C. I. Vat Blue 6; C. I. Acid Blue 45; and copper phthalocyanine pigments in which the phthalocyanine skeleton is substituted by 1 to 5 phthalimidomethyl groups.

Pigments that present a green color can be exemplified by the following: C. I. Pigment Green 7, 8, and 36.

Pigments that present an orange color can be exemplified by the following: C. I. Pigment Orange 66 and 51.

Pigments that present a black color can be exemplified by the following: carbon black, titanium black, and aniline black.

White pigments can be specifically exemplified by the following: basic lead carbonate, zinc oxide, titanium oxide, and strontium titanate.

Here, titanium oxide has a smaller specific gravity and a higher refractive index and is also more chemically and physically stable than the other white pigments and therefore has a high hiding power and tinting strength as a pigment and in addition has an excellent durability versus acid and alkali and other environments. The use of titanium oxide for the white pigment is therefore preferred. Other white pigments (including white pigments other than those provided as examples) may of course also be used as necessary.

For example, a ball mill, sand mill, attritor, roll mill, jet mill, homogenizer, paint shaker, kneader, agitator, Henschel mixer, colloid mill, ultrasonic homogenizer, pearl mill, wet jet mill, and so forth can be used as the dispersing apparatus for dispersing the pigment.

[Solvent]

The solvent should be a solvent that can dissolve the binder resin but is not otherwise particularly limited. The following are examples: ethers such as tetrahydrofuran, ketones such as methyl ethyl ketone and cyclohexanone, esters such as ethyl acetate, and halides such as chloroform. It may also be an aromatic hydrocarbon, e.g., toluene, benzene, and so forth, to the extent that the ability to dissolve the resin is present. The SP value of the solvent is preferably at least 8.7 and not more than 13.8 and is more preferably at least 8.8 and not more than 12.5.

Viewed from the standpoint of the ease of precipitation, the SP values of the binder resin, solvent, and curable insulating liquid preferably follow the sequence binder resin, solvent, curable insulating liquid in order of descending SP value.

The solubility parameter (SP) value is a factor that governs the solubility between a resin and a solvent. The trend is generally that polar resins readily dissolve in polar solvents and are difficult to dissolve in nonpolar solvents. The reverse trend holds, on the other hand, for nonpolar resins. A factor that assesses the strength of this affinity is the solubility parameter (SP value), represented with a δ. A smaller difference between the SP value of the solvent and the SP value of the solute generally indicates a higher solubility. The SP value is the solubility parameter. The SP value is a value introduced by Hildebrand and defined by a formal theory. It is given by the square root of the cohesive energy density of the solvent (or solute) and is a measure of the solubility in a two-component system solution. In the present invention, the SP value is the value determined by calculation from the vaporization energy and molar volume of the atoms and atomic groups in accordance with Fedors as described in Coating Basics and Engineering (page 53, Yuji Harasaki, Converting Technical Institute).

The unit for the SP value in the present invention is $(cal/cm^3)^{1/2}$, but this can be converted to the $(J/m^3)^{1/2}$ unit using $1(cal/cm^3)^{1/2}=2.046\times10^3(J/m^3)^{1/2}$.

[Binder Resin]

The known binder resins that exhibit a fixing performance for adherends such as paper and plastic film can be used as the binder resin, and as necessary a single one of these may be used by itself or two or more may be used in combination.

Specific examples are homopolymers of styrene and its substituted forms, e.g., polystyrene, poly-p-chlorostyrene, and polyvinyltoluene; styrenic copolymers, e.g., styrene-p-chlorostyrene copolymers, styrene-vinyltoluene copolymers, styrene-vinylnaphthalene copolymers, styrene-acrylate ester copolymers, styrene-methacrylate ester copolymers, styrene-methyl α-chloroacrylate copolymers, styrene-vinyl methyl ether copolymers, styrene-vinyl ethyl ether copolymers, styrene-vinyl methyl ketone copolymers, and styrene-acrylonitrile copolymers; as well as polyvinyl chlorides, phenolic resins, naturally modified phenolic resins, natural resin-modified maleic acid resins, acrylic resins, methacrylic resins, polyvinyl acetates, silicone resins, polyester resins, polyurethanes, polyamide resins, furan resins, epoxy resins, xylene resins, polyvinyl butyrals, terpene resins, coumarone-indene resins, and petroleum resins.

Polyester resins are preferred among the preceding from the standpoint of the granulating properties. The polyester resin is more preferably a polyester resin provided by the condensation polymerization of an alcohol monomer with a carboxylic acid monomer.

The alcohol monomer can be exemplified by the following: alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, as well as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The carboxylic acid monomer, on the other hand, can be exemplified by the following: aromatic dicarboxylic acids such as phthalic acid, isophthalic acid, and terephthalic acid, and their anhydrides; alkyl dicarboxylic acids such as succinic acid, adipic acid, sebacic acid, and azelaic acid, and their anhydrides; succinic acid substituted by a $C_{6-18}$ alkyl group or alkenyl group, and the anhydrides thereof; and unsaturated dicarboxylic acids such as fumaric acid, maleic acid, and citraconic acid, and their anhydrides.

The following monomers can also be used in addition to the preceding:

polyhydric alcohols such as glycerol, sorbitol, and sorbitan as well as, for example, the oxyalkylene ethers of novolac-type phenolic resins; polybasic carboxylic acids such as trimellitic acid, pyromellitic acid, and benzophenonetetracarboxylic acid, and their anhydrides.

Moreover, among the preceding, either the carboxylic acid monomer or the alcohol monomer preferably has an aromatic ring. The presence of the aromatic ring can bring about a reduction in the crystallinity of the polyester resin and improve the solubility in the solvent.

The polyester resin in the present invention preferably has a unit represented by the following general formula (2)

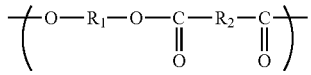

(2)

[In formula (2), at least one of $R_1$ and $R_2$ has an aromatic ring.].

$R_1$ is a structure derived from a diol and preferably is, for example, a structure derived from an alkylene oxide adduct of bisphenol A, a structure derived from a polyethylene glycol, phenylene, or a $C_{1-10}$ saturated or unsaturated aliphatic hydrocarbon group; in addition, the following formula (3) is also preferred for the structure represented by —O—$R_1$—O—

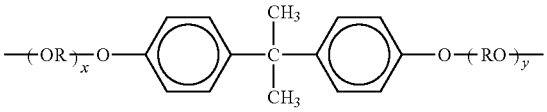

(3)

(In formula (3), R represents a propylene group; x and y are each integers equal to or greater than 1; and the average value of x+y is 2 to 10.}.

$R_2$ is a structure derived from a dicarboxylic acid and is preferably, for example, phenylene or a $C_{1-4}$ saturated or unsaturated aliphatic hydrocarbon group.

An SP value as described above can be calculated for these resins. In the present invention, the difference between the SP value of the binder resin and the SP value of the curable insulating liquid is preferably at least 2.6 and not more than 7.0, more preferably at least 2.9 and not more than 5.0, and even more preferably at least 3.0 and not more than 5.0.

The SP value of the binder resin is preferably at least 9.0 and not more than 15.0 and is more preferably at least 9.5 and not more than 13.0.

The weight-average molecular weight of the polyester resin is preferably at least 5,000 and not more than 30,000 and is more preferably at least 6,000 and not more than 25,000. Having the weight-average molecular weight be in this range makes it possible to keep the resin solution at an appropriate viscosity at the time of granulation and thus makes it possible to form a high-circularity particle having a small particle diameter.

The acid value of the polyester resin is preferably at least 5 mg KOH/g and not more than 100 mg KOH/g and is more preferably at least 5 mg KOH/g and not more than 50 mg KOH/g. Having the acid value be in this range makes it possible to keep the resin solution at an appropriate viscosity at the time of granulation and also makes it possible to promote interaction with the toner particle dispersing agent.

[Pigment Dispersing Agent]

A pigment dispersing agent may also be added to the curable liquid developer according to the present invention. The pigment dispersing agent can be exemplified by hydroxyl group-bearing carboxylate esters, the salts of long-chain polyaminoamides and high molecular weight acid esters, the salts of high molecular weight polycarboxylic acids, high molecular weight unsaturated acid esters, high molecular weight copolymers, polyesters and modifications thereof, modified polyacrylates, aliphatic polybasic carboxylic acids, naphthalenesulfonic acid/formalin condensates, polyoxyethylene alkyl phosphate esters, and pigment derivatives. The use of commercially available pigment dispersants such as the Solsperse series from The Lubrizol Corporation is also preferred. A synergist adapted to the particular pigment may also be used. These pigment dispersing agents and pigment dispersing aids are added preferably at 1 to 100 mass parts per 100 mass parts of the pigment and more preferably at 1 to 50 mass parts.

The amount of addition of the pigment, expressed per 100 mass parts of the binder resin, is preferably 1 to 100 mass parts and more preferably 5 to 50 mass parts.

There are no particular limitations on the method of adding the pigment dispersing agent, but addition in the pigment dispersion step is preferred from the standpoint of the pigment dispersibility.

[Toner Particle Dispersing Agent]

The toner particle dispersing agent in the present invention promotes toner particle formation and brings about a stable dispersion of the toner particles in the curable insulating liquid.

When the curable liquid developer is produced using a coacervation method, dispersing the toner particles in the curable insulating liquid in the presence of the toner particle dispersing agent makes it possible to increase the dispersion stability of the toner particles in the medium. The charging characteristics and mobility of the toner particle can also be improved.

This toner particle dispersing agent should be able to bring about a stable dispersion of the toner particles, but its type is not otherwise particularly limited. In addition, it may dissolve or disperse in the curable insulating liquid. Within the realm of commercial products, this toner particle dispersing agent can be exemplified by Ajisper PB817 (Ajinomoto Co., Inc.) and Solsperse 11200, 13940, 17000, and 18000 (Lubrizol Japan Ltd.).

The toner particle dispersing agent is preferably added in the range from 0.5 to 20 mass parts per 100 mass parts of the binder resin. Within this range, an excellent dispersibility is obtained and the toner particle dispersing agent also does not trap the curable insulating liquid and an excellent fixing strength by the toner particle can then be maintained. A single toner particle dispersing agent or two or more may be used in the present invention.

[The Curable Insulating Liquid]

The curable insulating liquid used in the present invention is preferably prepared so as to have the same property values as ordinary insulating liquids. Specifically, the volume resistivity is preferably $1\times10^{9}$ to $1\times10^{13}$ Ωcm and the viscosity at 25° C. is preferably 0.5 to 200 mPa·s and is more preferably 0.5 to 30 mPa·s. Having the volume resistivity be in the indicated range serves to suppress drops in the potential of the electrostatic latent image and facilitate obtaining a high optical density and thereby suppresses the production of image blur. Having the viscosity be in the indicated range makes it possible to improve the electrophoretic mobility of the toner particle and maintain an excellent print speed.

The curable insulating liquid of the present invention is preferably selected from a range that does not dissolve the binder resin. Specifically, it is preferably selected from curable insulating liquid/binder resin combinations for which not more than 1 mass parts of the binder resin dissolves per 100 mass parts (25° C.) of the curable insulating liquid. Toner particle formation can be substantially impaired when the binder resin solubility is in a range exceeding this.

In addition, the curable insulating liquid of the present invention is selected from polymerizable liquid monomers (preferably cationically polymerizable liquid monomers). The polymerizable liquid monomer can be exemplified by acrylic monomers and cyclic ether monomers such as epoxides and oxetanes. Among the preceding, the use of vinyl ether compounds for the present invention is particularly preferred. Vinyl ether compounds present little polarization in the intramolecular electron density, and due to this the use of a vinyl ether compound makes it possible to obtain a high-sensitivity curable liquid developer with a high resistance and a low viscosity. When a vinyl ether compound is used for the curable insulating liquid, other polymerizable liquid monomers may also be used to the extent that the properties of the present invention are not impaired.

A vinyl ether compound refers to a compound that has a vinyl ether structure (—CH═CH—O—C—).

This vinyl ether structure is preferably given by R—CH═CH—O—C— (R is hydrogen or $C_{1-3}$ alkyl and is preferably hydrogen or methyl).

A vinyl ether compound more preferred for the present invention does not contain a heteroatom outside the vinyl ether structure. Here, "heteroatom" denotes an atom other than the carbon atom and hydrogen atom. When such a heteroatom is present in the vinyl ether compound, this facilitates the appearance of an intramolecular polarization of the electron density due to the difference between the electronegativity of the heteroatom and that of the carbon atom; also, the empty electron orbitals and/or unshared electron pairs possessed by the heteroatom can readily form pathways for conduction electrons or holes. As a consequence, a trend is assumed wherein the resistance readily declines.

The vinyl ether compound also preferably does not contain a carbon-carbon double bond outside of the vinyl ether structure. The carbon-carbon double bond has a high energy level electron occupied orbital and a low energy level electron unoccupied orbital, and these readily form a pathway for electrons and holes and then readily lead to a decline in the resistance. When a double bond is present in the vinyl ether compound outside of the vinyl ether group, a trend is then assumed wherein the resistance is readily reduced by this mechanism.

The vinyl ether compound is preferably represented by the following general formula (1) in the present invention.

$$(H_2C{=}CH{-}O{-})_{n}R \quad (1)$$

[In formula (1), n represents the number of vinyl ether structures in one molecule and is an integer from 1 to 4. R is an n-valent hydrocarbon group.]

n is preferably an integer from 1 to 3.

R preferably is a group selected from $C_{1-2C}$ linear-chain or branched, saturated or unsaturated aliphatic hydrocarbon groups, $C_{5-12}$ saturated or unsaturated alicyclic hydrocarbon groups, and $C_{6-14}$ aromatic hydrocarbon groups, and these alicyclic hydrocarbon groups and aromatic hydrocarbon groups may have a $C_{1-4}$ saturated or unsaturated aliphatic hydrocarbon group.

R is more preferably a $C_{4-18}$ linear-chain or branched saturated aliphatic hydrocarbon group.

Specific examples of vinyl ether compounds that can be used in the present invention are given below (example compounds B-1 to B-30), but the present invention is not limited to these examples.

(B-1)

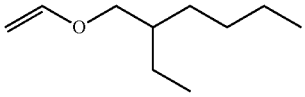

(B-2)

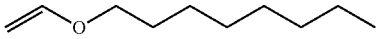

(B-3)

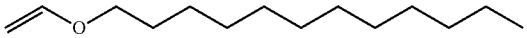

(B-4)

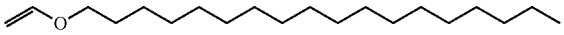

(B-5)

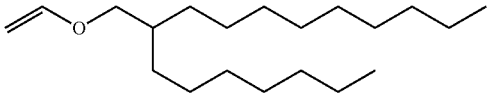

(B-6)

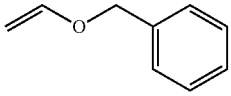

(B-7)

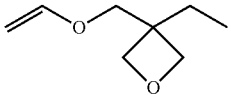

(B-8)

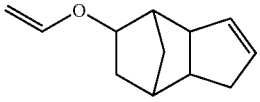

-continued (B-9)

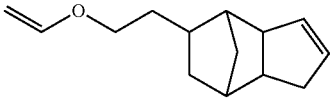

(B-10)

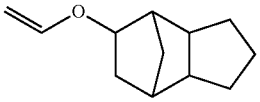

(B-11)

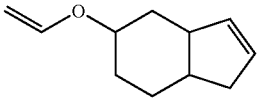

(B-12)

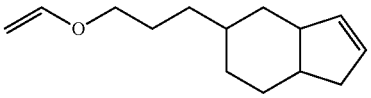

(B-13)

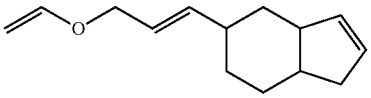

(B-14)

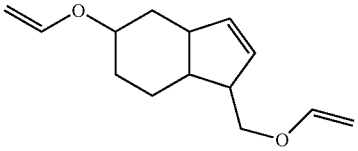

(B-15)

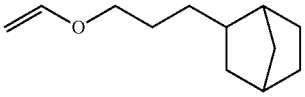

(B-16)

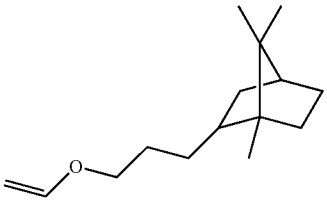

(B-17)

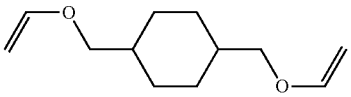

(B-18)

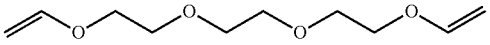

(B-19)

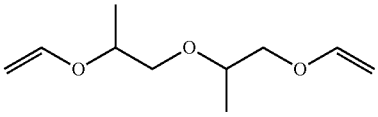

(B-20)

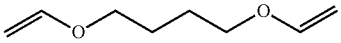

(B-21)

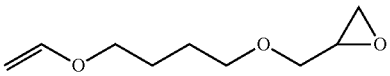

(B-22)

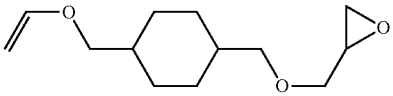

-continued (B-23)

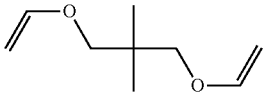

(B-24)

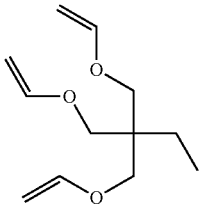

(B-25)

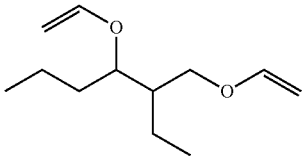

(B-26)

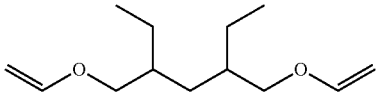

(B-27)

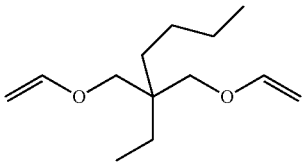

(B-28)

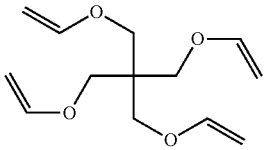

(B-29)

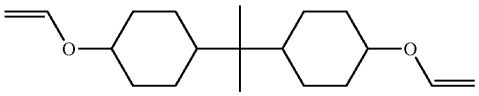

(B-30)

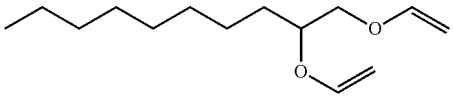

The following, for example, are particularly preferred among the preceding: dodecyl vinyl ether (B-3), dicyclopentadiene vinyl ether (B-8), cyclohexanedimethanol divinyl ether (B-17), triethylene glycol divinyl ether (B-18), tricyclodecane vinyl ether (B-10), trimethylolpropane trivinyl ether (B-24), 2-ethyl-1,3-hexanediol divinyl ether (B-25), 2,4-diethyl-1,5-pentanediol divinyl ether (B-26), 2-butyl-2-ethyl-1,3-propanediol divinyl ether (B-27), neopentyl glycol divinyl ether (B-23), pentaerythritol tetravinyl ether (B-28), and 1,2-decanediol divinyl ether (B-30).

The SP value of the curable insulating liquid, e.g., the aforementioned vinyl ether compound and so forth, is preferably at least 7.0 and not more than 8.5 and is more preferably at least 7.5 and not more than 8.3.

[Photopolymerization Initiator]

The photopolymerization initiator in the present invention is a compound that reacts to light at a prescribed wavelength and thereby generates an acid or a radical. Such a compound can be exemplified by cationic photopolymerization initiators such as onium salt compounds, sulfone compounds, sulfonate ester compounds, sulfonimide compounds, and diazomethane compounds, but is not limited to the preceding. In addition, radical photopolymerization initiators can be exemplified by benzoin derivatives, but are not limited thereto.

The photopolymerization initiator represented by the following formula (6) is more preferably used in the present invention; and it provides little reduction in the volume resistivity of ultraviolet-curable liquids.

(6)

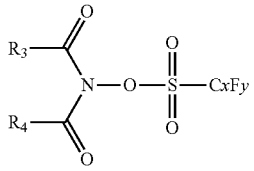

[In formula (6), $R_3$ and $R_4$ are bonded to each other to form a ring structure. x represents an integer from 1 to 8, and y represents an integer from 3 to 17.]

The ring structure here can be exemplified by 5-membered rings and 6-membered rings. Specific examples are succinimide structures, phthalimide structures, norbornene dicarboximide structures, naphthalene dicarboximide structures, cyclohexane dicarboximide structures, and epoxycyclohexene dicarboximide structures. These ring structures may also have, for example, the following as substituents: a $C_{1-4}$ alkyl group, $C_{1-4}$ alkyloxy group, $C_{1-4}$ alkylthio group, $C_{6-1C}$ aryl group, $C_{6-10}$ aryloxy group, $C_{6-10}$ arylthio group, and so forth.

The $C_xF_y$ in general formula (6) can be exemplified by linear-chain alkyl groups in which the hydrogen atom has been substituted by the fluorine atom (RF1), branched-chain alkyl groups in which the hydrogen atom has been substituted by the fluorine atom (RF2), cycloalkyl groups in which the hydrogen atom has been substituted by the fluorine atom (RF3), and aryl groups in which the hydrogen atom has been substituted by the fluorine atom (RF4).

The linear-chain alkyl groups in which the hydrogen atom has been substituted by the fluorine atom (RF1) can be exemplified by the trifluoromethyl group (x=1, y=3), pentafluoroethyl group (x=2, y=5), nonafluorobutyl group (x=4, y=9), perfluorohexyl group (x=6, y=13), and perfluorooctyl group (x=8, y=17).

The branched-chain alkyl groups in which the hydrogen atom has been substituted by the fluorine atom (RF2) can be exemplified by the perfluoroisopropyl group (x=3, y=7), perfluoro-tert-butyl group (x=4, y=9), and perfluoro-2-ethylhexyl group (x=8, y=17).

The cycloalkyl groups in which the hydrogen atom has been substituted by the fluorine atom (RF3) can be exemplified by the perfluorocyclobutyl group (x=4, y=7), perfluorocyclopentyl group (x=5, y=9), perfluorocyclohexyl group (x=6, y=11), and perfluoro(1-cyclohexyl)methyl group (x=7, y=13).

The aryl groups in which the hydrogen atom has been substituted by the fluorine atom (RF4) can be exemplified by the pentafluorophenyl group (x=6, y=5) and 3-trifluoromethyltetrafluorophenyl group (x=7, y=7).

For the $C_xF_y$ in general formula (6), the linear-chain alkyl groups (RF1), branched-chain alkyl groups (RF2), and aryl groups (RF4) are preferred from the standpoint of the each of acquisition and the decomposability of the sulfonate ester moiety, while the linear-chain alkyl groups (RF1) and aryl groups (RF4) are more preferred and the trifluoromethyl group (x=1, y=3), pentafluoroethyl group (x=2, y=5), heptafluoropropyl group (x=3, y=7), nonafluorobutyl group (x=4, y=9), and pentafluorophenyl group (x=6, y=5) are particularly preferred.

A single photopolymerization initiator can be used or two or more photopolymerization initiators can be used. The content of the photopolymerization initiator in the ultraviolet curable liquid developer composition of the present invention is not particularly limited, but, expressed per 100 mass parts of the curable insulating liquid, is preferably 0.01 to 5 mass parts, more preferably 0.05 to 1 mass parts, and even more preferably 0.1 to 0.5 mass parts.

[Additives]

The curable liquid developer of the present invention preferably contains the following additives on an optional basis.

[Sensitizer]

As necessary, a sensitizer may be added to the curable liquid developer of the present invention with the goals of, for example, improving the acid-generating efficiency of the photopolymerization initiator and extending the photosensitive wavelengths to longer wavelengths. Any sensitizer may be used that is capable of sensitizing the photopolymerization initiator through an electron transfer mechanism or energy transfer mechanism. Preferred examples include aromatic polycondensed ring compounds such as anthracene, 9,10-dialkoxyanthracene, pyrene, and perylene; aromatic ketone compounds such as acetophenone, benzophenone, thioxanthone, and Michler's ketone; and heterocyclic compounds such as phenothiazine and N-aryloxazolidinone. The amount of addition is selected as appropriate in correspondence to the goal, and preferably is 0.1 to 10 mass parts and more preferably 1 to 5 mass parts per 1 mass parts of the photopolymerization initiator.

A co-sensitizer may also be added to the ultraviolet-curable liquid developer of the present invention with the goal of improving the electron transfer efficiency or energy transfer efficiency between the aforementioned sensitizer and the photopolymerization initiator.

The co-sensitizer can be specifically exemplified by the following: naphthalene compounds such as 1,4-dihydroxynaphthalene, 1,4-dimethoxynaphthalene, 1,4-diethoxynaphthalene, 4-methoxy-1-naphthol, and 4-ethoxy-1-naphthol, and benzene compounds such as 1,4-dihydroxybenzene, 1,4-dimethoxybenzene, 1,4-diethoxybenzene, 1-methoxy-4-phenol, and 1-ethoxy-4-phenol.

The amount of co-sensitizer addition is selected as appropriate in correspondence to the goal, but is preferably 0.1 to 10 mass parts and more preferably 0.5 to 5 mass parts per 1 mass parts of the sensitizer.

[Cationic Polymerization Inhibitor]

A cationic polymerization inhibitor can also be added to the curable liquid developer of the present invention. The cationic polymerization inhibitor can be exemplified by alkali metal compounds and/or alkaline-earth metal compounds and by amines.

Preferred examples of the amine include alkanolamines, N,N-dimethylalkylamines, N,N-dimethylalkenylamines, and N,N-dimethylalkynylamines. The amines can be specifically exemplified by triethanolamine, triisopropanolamine, tributanolamine, N-ethyldiethanolamine, propanolamine, n-butylamine, sec-butylamine, 2-aminoethanol, 2-methylaminoethanol, 3-methylamino-1-propanol, 3-methylamino-1,2-propanediol, 2-ethylaminoethanol, 4-ethylamino-1-butanol, 4-(n-butylamino)-1-butanol, 2-(t-butylamino)ethanol, N,N-dimethylundecanolamine, N,N-dimethyldodecanolamine, N,N-dimethyltridecanolamine, N,N-dimethyltetradecanolamine, N,N-dimethylpentadecanolamine, N,N-dimethylnonadecylamine, N,N-dimethylicosylamine, N,N-dimethyleicosylamine, N,N-dimethylheneicosylamine, N,N-dimethyldocosylamine, N,N-dimethyltricosylamine, N,N-dimethyltetracosylamine, N,N-dimethylpentacosylamine, N,N-dimethylpentanolamine, N,N-dimethylhexanolamine, N,N-dimethylheptanolamine, N,N-dimethyloctanolamine, N,N-dimethylnonanolamine, N,N-dimethyldecanolamine, N,N-dimethylnonylamine, N,N-dimethyldecylamine, N,N-dimethylundecylamine, N,N-dimethyldodecylamine, N,N-dimethyltridecylamine, N,N-dimethyltetradecylamine, N,N-dimethylpentadecylamine, N,N-dimethylhexadecylamine, N,N-dimethylheptadecylamine, and N,N-dimethyloctadecylamine. In addition to these, for example, a quaternary ammonium salt may also be used. The cationic polymerization inhibitor is particularly preferably a secondary amine.

The amount of addition of the cationic polymerization inhibitor is preferably 1 to 5,000 ppm on a mass basis with reference to the ultraviolet-curable liquid developer of the present invention.

[Radical Polymerization Inhibitor]

A radical polymerization inhibitor may be added to the curable liquid developer of the present invention.

In the case of an ultraviolet-curable liquid developer that contains a vinyl ether compound, during storage the photopolymerization initiator may undergo a trace decomposition and thereby convert into a radical compound and a polymerization caused by this radical compound may then be induced. A radical polymerization inhibitor is preferably added to prevent this.

Usable radical polymerization inhibitors can be exemplified by phenolic hydroxy group-containing compounds; quinones such as methoquinone (hydroquinone monomethyl ether), hydroquinone, and 4-methoxy-1-naphthol; hindered amine antioxidants; 1,1-diphenyl-2-picrylhydrazyl free radical; N-oxyl free radical compounds; nitrogen-containing heterocyclic mercapto compounds; thioether antioxidants; hindered phenol antioxidants; ascorbic acids; zinc sulfate; thiocyanates; thiourea derivatives; saccharides; phosphoric acid-type antioxidants; nitrites; sulfites; thiosulfates; hydroxylamine derivatives; aromatic amines; phenylenediamines; imines; sulfonamides; urea derivatives; oximes; polycondensates of dicyandiamide and polyalkylenepolyamine; sulfur-containing compounds such as phenothiazine; complexing agents based on tetraazaannulene (TAA); and hindered amines.

Phenols, N-oxyl free radical compounds, 1,1-diphenyl-2-picrylhydrazyl free radical, phenothiazine, quinones, and hindered amines are preferred from the standpoint of preventing the ultraviolet-curable liquid developer from undergoing a viscosity increase due to the polymerization of the vinyl ether compound, while N-oxyl free radical compounds are particularly preferred.

The amount of addition of the radical polymerization inhibitor is preferably 1 to 5,000 ppm on a mass basis relative to the ultraviolet-curable liquid developer of the present invention.

[Charge Control Agent]

The curable liquid developer of the present invention may as necessary contain a charge control agent. A known charge control agent can be used. Examples of specific compounds are as follows: fats and oils such as linseed oil and soy oil; alkyd resins; halogen polymers; aromatic polycarboxylic acids; acidic group-containing water-soluble dyes; oxidative condensates of aromatic polyamines; metal soaps such as cobalt naphthenate, nickel naphthenate, iron naphthenate, zinc naphthenate, cobalt octanoate, nickel octanoate, zinc octanoate, cobalt dodecanoate, nickel dodecanoate, zinc dodecanoate, aluminum stearate, and cobalt 2-ethylhexanoate; metal sulfonates such as petroleum-based metal sulfonates and metal salts of sulfosuccinate esters; phospholipids such as lecithin; metal salicylates such as metal t-butyl salicylate complexes; polyvinylpyrrolidone resins; polyamide resins; sulfonic acid-containing resins; and hydroxybenzoic acid derivatives.

In addition to the preceding, the aforementioned colored resin dispersion may as necessary incorporate other additives.

[Charge Adjuvant]

A charge adjuvant can be added to the toner particle with the goal of adjusting the charging performance of the toner particle. A known charge adjuvant can be used.

Examples of specific compounds are as follows: metal soaps such as zirconium naphthenate, cobalt naphthenate, nickel naphthenate, iron naphthenate, zinc naphthenate, cobalt octoate, nickel octoate, zinc octoate, cobalt dodecyl, nickel dodecyl, zinc dodecyl, aluminum stearate, aluminum tristearate, and cobalt 2-ethylhexanoate; metal sulfonates such as petroleum-based metal sulfonates and the metal salts of sulfosuccinate esters; phospholipids such as lecithin; metal salicylates such as metal t-butyl salicylate complexes; polyvinylpyrrolidone resins; polyamide resins; sulfonic acid-containing resins; and hydroxybenzoic acid derivatives.

[Other Additives]

In addition to those described above, various known additives, e.g., surfactant, lubricant, filler, antifoaming agent, ultraviolet absorber, antioxidant, anti-fading agent, fungicide, anticorrosion agent, and so forth, can as necessary be selected as appropriate and used in the curable liquid developer of the present invention with the goal of improving the compatibility with recording media, the storage stability, the image storability, and other characteristics.

The production method described in the preceding can produce an ultraviolet-curable liquid developer in which pigment-containing toner particles dispersed in a curable insulating liquid have a small particle diameter and a narrow particle size distribution, wherein in addition the ultraviolet-curable liquid developer has an excellent dispersion stability, excellent developing characteristics, and an excellent curability.

[The Image-Forming Apparatus]

The curable liquid developer of the present invention can be advantageously used in typical image-forming apparatuses that use an electrophotographic system.

[The Ultraviolet Light Source]

The image is preferably fixed by curing the curable liquid developer of the present invention through its exposure to ultraviolet radiation immediately after transfer to a recording medium.

The light source here for carrying out ultraviolet irradiation is suitably, for example, a mercury lamp, metal halide lamp, excimer laser, ultraviolet laser, cold cathode tube, hot cathode tube, black light, or light-emitting diode (LED). A strip-shaped metal halide lamp, cold cathode tube, hot cathode tube, mercury lamp, black light, or LED is preferred.

The ultraviolet dose is preferably from 0.1 to 1,000 $mJ/cm^2$.

[Molecular Weight Measurement]

The molecular weight of the binder resins involved with the execution of the present invention is determined as polystyrene using size exclusion chromatograph (SEC). The measurement of the molecular weight by SEC was carried out as follows.

A solution was prepared by adding the sample to the eluent indicated below to provide a sample concentration of 1.0% and standing for 24 hours at room temperature. This solution was filtered across a solvent-resistant membrane filter with a pore diameter of 0.2 μm to obtain the sample solution, and measurement was performed under the following conditions.

instrument: "HLC-8220GPC" high-performance GPC instrument (from the Tosoh Corporation)

column: 2×LF-804 eluent: THF flow rate: 1.0 mL/minute oven temperature: 40° C.

sample injection amount: 0.025 mL

The molecular weight calibration curve used to determine the molecular weight of the sample was constructed using polystyrene resin standards [TSK Standard Polystyrene F-850, F-450, F-288, F-128, F-80, F-40, F-20, F-10, F-4, F-2, F-1, A-5000, A-2500, A-1000, and A-500, from the Tosoh Corporation].

[Measurement of the Acid Value]

The acid value of the binder resins and toner particle dispersing agents involved in the execution of the present invention is determined using the following method.

The basic procedure is based on JIS K 0070.

1) Weigh out exactly 0.5 to 2.0 g of the sample. This mass is designated M (g).

2) Place the sample in a 50-mL beaker and add 25 mL of a tetrahydrofuran/ethanol (2/1) mixture and dissolve.

3) Perform titration using an ethanol solution of 0.1 mol/L KOH and using a potentiometric titrator [for example, a "COM-2500" automatic titrator from Hiranuma Sangyo Co., Ltd. can be used].

4) The amount of the KOH solution used at this time is designated S (mL). The blank is measured at the same time, and the amount of KOH used for this is designated B (mL).

5) The acid value is calculated using the following formula. f is the factor for the KOH solution.

$$\text{acid value [mg KOH/g]} = \frac{(S-B)\times f\times 5.61}{M}$$

EXAMPLES

The present invention is described in detail in the following using examples, but the present invention is not limited to or by these examples. Unless specifically indicated otherwise, "parts" and "%" denote, respectively, "mass parts" and "mass %".

Example 1

<Synthesis of Pigment Dispersing Agent>

100 parts of a toluene solution (50% solids fraction) of an isocyanate group-bearing polycarbodiimide compound having a carbodiimide equivalent weight of 262 and 8.5 parts of N-methyldiethanolamine were introduced and held for 3 hours at approximately 100° C. to react the isocyanate group with the hydroxyl group. This was followed by the introduction of 39.6 parts of an s-caprolactone self-polycondensate having the carboxyl group in terminal position and having a number-average molecular weight of 8500; holding for 2 hours at approximately 80° C. to react the carbodiimide group and carboxyl group; and then distillative removal of the toluene under reduced pressure to obtain a pigment dispersing agent (100% solids fraction) having a number-average molecular weight of approximately 13,000.

<Pigment Dispersion Step>

10 mass parts of a pigment (Carbon Black MA-7, Mitsubishi Chemical Corporation), 10 mass parts of the pigment dispersing agent, and 80 mass parts of a solvent (tetrahydrofuran (THF)) were mixed and kneading was carried out for 1 hour in a paint shaker using steel beads with a diameter of 5 mm to obtain a kneadate 1.

60 mass parts of the thusly obtained kneadate 1, 80 mass parts of a 50% THF solution of a polyester resin 1 [polyoxypropylene(2.0)-2,2-bis(4-hydroxyphenyl)propane:terephthalic acid:trimellitic acid (molar ratio)=50:40:10, Tg=59° C., Tm=105° C., SP value=11.2 $(cal/cm^3)^{1/2}$, acid value=18 mg KOH/g, weight-average molecular weight=$2.5\times10^4$], and 12 mass parts of a toner particle dispersing agent (Ajisper PB-817, Ajinomoto Co., Inc.) were mixed using a high-speed disperser (T.K. Robomix/T.K. Homodisper Model 2.5 blade, Primix Corporation), and mixing while stirring at 40° C. was carried out to obtain a pigment dispersion 1.

<Mixing Step>

While carrying out high-speed stirring (rotation rate=25,000 rpm) using a homogenizer (Ultra-Turrax T50 from IKA), 200 mass parts of dodecyl vinyl ether (DDVE) was added in small portions to the pigment dispersion 1 (100 mass parts) obtained as described above, thus obtaining a mixture 1.

When the mixing step was finished, the binder resin was in a phase-separated state.

<Distillative Removal Step>

Mixture 1 was transferred to a recovery flask and the THF was completely distilled off at 50° C. while carrying out ultrasound dispersion, to obtain an ultraviolet-curable liquid toner particle dispersion 1 that contained toner particles in an ultraviolet-curable insulating liquid.

<Liquid Developer Preparation Step>

The obtained toner particle dispersion 1 (10 mass parts) was subjected to centrifugal separation; the supernatant was removed by decantation and replaced with fresh DDVE in a mass equal to that of the removed supernatant; redispersion was carried out; and an ultraviolet curable liquid developer 1 was obtained by the addition of 0.10 parts of Lecinol S-10 (hydrogenated lecithin, Nikko Chemicals Co., Ltd.), 90 parts of dipropylene glycol divinyl ether as a polymerizable liquid monomer, 0.30 parts of the photopolymerization initiator represented by formula (A-1) below, and 1 parts of KAYAKURE-DETX-S(Nippon Kayaku Co., Ltd.). The time required for production was 12 hours or less.

(A-1)

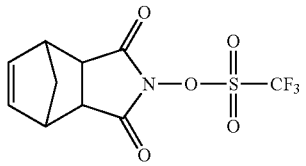

Example 2

An ultraviolet-curable liquid toner particle dispersion 2 and an ultraviolet-curable liquid developer 2 were obtained proceeding as in Example 1, but changing the dodecyl vinyl ether (SP value=8.1$(cal/cm^3)^{1/2}$) to trimethylolpropane trivinyl ether (SP value=8.3 $(cal/cm^3)^{1/2}$).

When the mixing step was finished, the binder resin was in a phase-separated state.

Example 3

An ultraviolet-curable liquid toner particle dispersion 3 and an ultraviolet-curable liquid developer 3 were obtained proceeding as in Example 1, but changing the polyester resin 1 to a polyester resin 2 [polyoxypropylene(2.0)-2,2-bis(4-hydroxyphenyl)propane:terephthalic acid:trimellitic acid (molar ratio)=50:25:25, Tg=61° C., Tm=109° C., SP value=11.4$(cal/cm^3)^{1/2}$, acid value=31 mg KOH/g, weight-average molecular weight=$1.1\times10^4$].

When the mixing step was finished, the binder resin was in a phase-separated state.

Example 4

An ultraviolet-curable liquid toner particle dispersion 4 and an ultraviolet-curable liquid developer 4 were obtained proceeding as in Example 1, but changing the polyester resin 1 to a polyester resin 3 [polyoxypropylene(2.0)-2,2-bis(4-hydroxyphenyl)propane:terephthalic acid:trimellitic acid (molar ratio)=50:40:10, Tg=57° C., Tm=98° C., SP value=11.2$(cal/cm^3)^{1/2}$, acid value=18 mg KOH/g, weight-average molecular weight=$5.1\times10^3$].

When the mixing step was finished, the binder resin was in a phase-separated state.

Example 5

An ultraviolet-curable liquid toner particle dispersion 5 and an ultraviolet-curable liquid developer 5 were obtained proceeding as in Example 1, but changing the polyester resin 1 to a polyester resin 4 [polyoxypropylene(2.2)-2,2-bis(4-hydroxyphenyl)propane:fumaric acid (molar ratio)=50:50, SP value=10.7$(cal/cm^3)^{1/2}$, acid value=5 mg KOH/g, weight-average molecular weight=$1.5\times10^4$].

When the mixing step was finished, the binder resin was in a phase-separated state.

Example 6

An ultraviolet-curable liquid toner particle dispersion 6 and an ultraviolet-curable liquid developer 6 were obtained proceeding as in Example 1, but changing the polyester resin 1 to a polyester resin 5 [polyoxypropylene(2.2)-2,2-bis(4-hydroxyphenyl)propane:fumaric acid (molar ratio)=50:50, SP value=10.7$(cal/cm^3)^{1/2}$, acid value=4 mg KOH/g, weight-average molecular weight=$3.3\times10^4$].

When the mixing step was finished, the binder resin was in a phase-separated state.

Example 7

An ultraviolet-curable liquid toner particle dispersion 7 and an ultraviolet-curable liquid developer 7 were obtained proceeding as in Example 1, but changing the polyester resin 1 to a polyester resin 6 [polyoxypropylene(2.2)-2,2-bis(4-hydroxyphenyl)propane:adipic acid:trimellitic acid (molar ratio)=50:46:4, SP value=10.6(cal/cm$^3$)$^{1/2}$, acid value=4 mg KOH/g, weight-average molecular weight=2.5×10$^4$].

When the mixing step was finished, the binder resin was in a phase-separated state.

Example 8

An ultraviolet-curable liquid toner particle dispersion 8 and an ultraviolet-curable liquid developer 8 were obtained proceeding as in Example 1, but changing the polyester resin 1 to a polyester resin 7 [adipic acid:1,6-hexanediol (molar ratio)=1:1, SP value=10.4 (cal/cm$^3$)$^{1/2}$, acid value=3 mg KOH/g, weight-average molecular weight=2.2×10$^4$].

When the mixing step was finished, the binder resin was in a phase-separated state.

Example 9

An ultraviolet-curable liquid toner particle dispersion 9 and an ultraviolet-curable liquid developer 9 were obtained proceeding as in Example 1, but changing the polyester resin 1 to polyester resin 6 and changing the dodecyl vinyl ether (SP value=8.1 (cal/cm$^3$)$^{1/2}$) to the aforementioned B-18 (SP value=8.6 (cal/cm$^3$)$^{1/2}$). When the mixing step was finished, the binder resin was in a phase-separated state.

Example 10

A curable liquid toner particle dispersion 10 and a curable liquid developer 10 were obtained proceeding as in Example 1, but changing the polyester resin 1 to polyester resin 7 and changing the dodecyl vinyl ether (SP value=8.1 (cal/cm$^3$)$^{1/2}$) to the aforementioned B-18 (SP value=8.6 (cal/cm$^3$)$^{1/2}$).

When the mixing step was finished, the binder resin was in a phase-separated state.

Example 11

A curable liquid toner particle dispersion 11 and a curable liquid developer 11 were obtained proceeding as in Example 1, but changing the polyester resin 1 to a styrene-acrylic resin 1 [styrene:acrylic acid (molar ratio)=4:1, SP value=11.0 (cal/cm$^3$)$^{1/2}$] and changing the dodecyl vinyl ether (SP value=8.1 (cal/cm$^3$)$^{1/2}$) to the aforementioned B-18 (SP value=8.6 (cal/cm$^3$)$^{1/2}$). The binder resin was not phase-separated when the mixing step was finished.

Example 12

A curable liquid toner particle dispersion 12 and a curable liquid developer 12 were obtained proceeding as in Example 1, but changing the polyester resin 1 to styrene-acrylic resin 1 and changing the dodecyl vinyl ether (SP value=8.1 (cal/cm$^3$)$^{1/2}$) to OXT-221 (oxetane, SP value=8.8 (cal/cm$^3$)$^{1/2}$). The binder resin was not phase-separated when the mixing step was finished.

Comparative Example 1

67 mass parts of the polyester resin 1, 10 mass parts of a pigment (Carbon Black MA-7, Mitsubishi Chemical Corporation), and 10 mass parts of a pigment dispersing agent (Vylon V-280, a polyester resin, Toyobo Co., Ltd.) were thoroughly mixed with a Henschel mixer and then melt-kneaded using a co-rotating twin-screw extruder at a roll interior heating temperature of 100° C. followed by cooling of the obtained mixture and coarse pulverization to obtain coarsely pulverized toner particles. An ultraviolet-curable liquid toner particle dispersion 11 was then obtained by mixing 80 mass parts of dodecyl vinyl ether (DDVE), 20 mass parts of the coarsely pulverized toner particles obtained as described above, and 4.5 mass parts of a toner particle dispersing agent (Ajisper PB-817, Ajinomoto Co., Inc.) for 24 hours with a sand mill.

The obtained toner particle dispersion 11 (10 mass parts) was subjected to centrifugal separation; the supernatant was removed by decantation and replaced with fresh DDVE in a mass equal to that of the removed supernatant; redispersion was carried out; and an ultraviolet curable liquid developer 11 was obtained by the addition of 0.10 parts of Lecinol S-10 (hydrogenated lecithin, Nikko Chemicals Co., Ltd.), 90 parts of dipropylene glycol divinyl ether as a polymerizable liquid monomer, 0.30 parts of the photopolymerization initiator represented by formula (A-1) above, and 1 parts of KAYAKURE-DETX-S(Nippon Kayaku Co., Ltd.).

Comparative Example 2

A resin solution was prepared by the addition of 5 mass parts of Neogen SC-F (Dai-ichi Kogyo Seiyaku Co., Ltd.) as an emulsifying agent to the pigment dispersion (100 mass parts) used in Example 1. This was followed by the addition of 100 mass parts of 1 N aqueous ammonia to the resin solution and thorough mixing with a high-speed disperser (T.K. Robomix/T.K. Homodisper Model 2.5 blade, Primix Corporation). While holding the temperature of the solution within the flask at 25° C., 80 mass parts of deionized water was added dropwise and, while continuing to stir, 20 mass parts of deionized water was added to produce, via the W/O emulsion, an O/W emulsion in which a resin material-containing dispersoid was dispersed.

This O/W emulsion was then transferred to a stirred container and, after bringing the temperature of the O/W emulsion to 25° C., 40 mass parts of a 5.0% aqueous sodium sulfate solution was added dropwise to carry out coalescence of the dispersoid and form coalesced particles. After the dropwise addition, stirring was continued until the volume-based 50% particle diameter Dv(50) [μm] for the coalesced particles had grown to 2.5 μm. Once the Dv(50) of the coalesced particles had reached 2.5 μm, 20 mass parts of deionized water was added and the O/W emulsion containing the coalesced particles was placed under a reduced pressure environment and the organic solvent was distilled off to obtain a slurry (dispersion) of toner base particles.

Solid/liquid separation was carried out on the obtained slurry (dispersion) followed by redispersion (reslurrying) in water, and a washing process was carried out by performing the solid/liquid separation repeatedly.

This was followed by drying the obtained wet cake using a vacuum dryer to obtain dry toner particles.

An ultraviolet-curable liquid toner particle dispersion 12 was obtained by mixing 20 mass parts of the dry toner particles obtained by the method described in the preceding, 80 mass parts of dodecyl vinyl ether (DDVE), and 4.5 mass parts of a toner particle dispersing agent (Ajisper PB-817, Ajinomoto Co., Inc.) for 24 hours with a sand mill.

The obtained toner particle dispersion 12 (10 mass parts) was subjected to centrifugal separation; the supernatant was removed by decantation and replaced with fresh DDVE in a mass equal to that of the removed supernatant; redispersion was carried out; and an ultraviolet curable liquid developer 12 was obtained by the addition of 0.10 parts of Lecinol S-10 (hydrogenated lecithin, Nikko Chemicals Co., Ltd.), 90 parts of dipropylene glycol divinyl ether as a polymerizable liquid monomer, 0.30 parts of the photopolymerization initiator represented by formula (A-1) above, and 1 parts of KAYAKURE-DETX-S(Nippon Kayaku Co., Ltd.).

[Evaluations]

Each liquid developer was evaluated using the following evaluation methods. The results are given in Table 1.

(Production Efficiency)

A: The time required for production was within 12 hours, and a toner particle drying step and a redispersion step were not required.

B: The time required for production was at least 24 hours and a toner particle drying step was not required; however, a redispersion step was required.

C: The time required for production was at least 24 hours and a toner drying step and a redispersion step were required.

(Developing Performance)

Using the image-forming apparatus shown in FIG. 1 and the obtained curable liquid developers, development was carried out using the following method and the quality of the obtained image was checked.

(1) A developing roller 13, a photosensitive drum 10, and an intermediate transfer roller 17 were separated from each other and these were driven in a noncontact condition at different rotations in the direction of the arrow in FIG. 1. The rotation rate here was 250 mm/sec.

(2) The developing roller 13 and the photosensitive drum 10 were brought into contact at a pressing pressure of 5 N/cm and a bias was established using a DC power source. Since the developing bias is desirably in the range from 100 to 400 V, 200 V was used.

(3) The photosensitive drum 10 and the intermediate transfer roller 17 were brought into contact at a prescribed pressing pressure and a bias was established using a DC power source. The transfer bias was made 1000 V.

(4) The intermediate transfer roller 17 and a secondary transfer roller were brought into contact at a prescribed pressing pressure and a bias was established using a DC power source. The transfer bias was made 1000 V.

(5) The liquid developer at a uniform concentration (toner particle concentration of 2 mass %) and a uniform amount (100 mL) was supplied to the liquid developer tank; an image was formed using a polyethylene terephthalate sheet (Teijin Limited, Panlite: PC-2151, thickness=0.3 mm) as the media 20; and evaluation was then carried out.

(Image Density)

The quality of the image was visually inspected.

A: A high-density, high-resolution image was obtained.

B: Image density non-uniformity and image blurring were not observed.

C: Some image density non-uniformity was present, or some image blurring was seen.

D: Severe image density non-uniformity and/or image blurring was produced and image deficiency locations were observed.

E: Development was not possible.

(Transferability)

The toner particle concentration on PET sheet and the presence/absence of residual toner particles at the intermediate transfer member were checked. The toner particle concentration was measured using the following method.

The image on the PET sheet was washed and dissolved with THF; the wash solution was measured by TG-DTA; and the toner particle concentration was calculated from the percentage for the mass loss of the carrier component in the range from 100° C. to 200° C. and the mass loss of the toner particle component in the range of 250° C. and above.

A: The toner particle concentration on the PET sheet was at least 60 mass % and almost no toner particles were seen to remain on the intermediate transfer member.

B: The toner particle concentration on the PET sheet was at least 50 mass % and almost no toner particles were seen to remain on the intermediate transfer member.

C: The toner particle concentration on the PET sheet was at least 40 mass % and toner particles remaining on the intermediate transfer member were observed to a moderate degree.

D: The toner particle concentration on the PET sheet was less than 40 mass % and toner particles remaining on the intermediate transfer member were observed to a moderate degree.

E: The toner particle concentration on the PET sheet was less than 40 mass % and toner particles were observed to remain on the intermediate transfer member in large amounts.

(Curability)

Each liquid developer was coated (thickness=8.0 μm) at room temperature on polyethylene terephthalate (PET) sheet using a wire bar (No. 6), and a cured film was then formed by exposure to a dose of 200 or 400 mJ/cm$^2$ (measurement wavelength=365 nm) from a high-pressure mercury lamp having a lamp output of 120 mW/cm$^2$. The film surface was touched with a finger immediately after curing to check for the presence/absence of surface tack (stickiness).

A: Tack was not observed at all at a dose of 200 mJ/cm$^2$.

B: Tack was not observed at all at a dose of 400 mJ/cm$^2$.

C: The film peels off when contacted with a finger, or curing has not occurred.

TABLE 1

| | materials | | SP value | | | evaluations | | | |
|---|---|---|---|---|---|---|---|---|---|
| | | | curable | | | | | | |
| | resin type | curable insulating liquid | resin (A) | insulating liquid (B) | A − B | production efficiency | developing performance | transfer-ability | curability |
| Example 1 | polyester resin 1 | DDVE | 11.2 | 8.1 | 3.1 | A | A | A | A |
| Example 2 | polyester resin 1 | trimethylolpropane trivinyl ether | 11.2 | 8.3 | 2.9 | A | A | A | A |
| Example 3 | polyester resin 2 | DDVE | 11.4 | 8.1 | 3.3 | A | A | A | A |
| Example 4 | polyester resin 3 | DDVE | 11.2 | 8.1 | 3.1 | A | A | A | A |
| Example 5 | polyester resin 4 | DDVE | 10.7 | 8.1 | 2.6 | A | A | A | A |
| Example 6 | polyester resin 5 | DDVE | 10.7 | 8.1 | 2.6 | A | A | B | A |
| Example 7 | polyester resin 6 | DDVE | 10.6 | 8.1 | 2.5 | A | B | B | A |
| Example 8 | polyester resin 7 | DDVE | 10.4 | 8.1 | 2.3 | A | B | C | A |
| Example 9 | polyester resin 6 | B-18 | 10.6 | 8.6 | 2.0 | A | B | C | A |

TABLE 1-continued

| | materials | | SP value | | | | evaluations | | |
|---|---|---|---|---|---|---|---|---|---|
| | | | curable | | | | | | |
| | resin type | curable insulating liquid | resin (A) | insulating liquid (B) | A − B | production efficiency | developing performance | transfer-ability | curability |
| Example 10 | polyester resin 7 | B-18 | 10.4 | 8.6 | 1.8 | A | C | C | A |
| Example 11 | styrene-acrylic resin 1 | B-18 | 11.0 | 8.6 | 2.4 | A | C | D | A |
| Example 12 | styrene-acrylic resin 1 | oxetane OXT-221 | 11.0 | 8.8 | 2.2 | A | C | D | B |
| Comparative Example 1 | polyester resin 1 | DDVE | 11.2 | 8.1 | 3.1 | B | E | E | B |
| Comparative Example 2 | polyester resin 1 | DDVE | 11.2 | 8.1 | 3.1 | C | D | D | B |

The results in Table 1 demonstrate that curable liquid developers can be produced in the examples of the present invention at an excellent production efficiency that is better than that in Comparative Examples 1 and 2, which are prior art.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107396, filed May 27, 2015, which is hereby incorporated by reference herein in its entirety.

What is claimed is:

1. A method of producing a curable liquid developer comprising a pigment, a binder resin, a toner particle dispersing agent, and a curable insulating liquid, the method comprising:

a pigment dispersion step of preparing a pigment dispersion comprising the pigment, the binder resin, the toner particle dispersing agent, and a solvent;

a mixing step of mixing the pigment dispersion with the curable insulating liquid; and a distillative removal step of distillatively removing the solvent from a mixture obtained in the mixing step.

2. The method of producing a curable liquid developer according to claim 1, wherein phase separation of the binder resin is brought about in the mixing step.

3. The method of producing a curable liquid developer according to claim 1, wherein the curable insulating liquid comprises a vinyl ether compound, and the binder resin comprises a polyester resin.

4. The method of producing a curable liquid developer according to claim 3, wherein the vinyl ether compound is represented by formula (1):

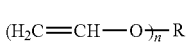

(1)

where n is an integer from 1 to 4 and R is an n-valent hydrocarbon group.

5. The method of producing a curable liquid developer according to claim 3, wherein the polyester resin has a unit represented by formula (2):

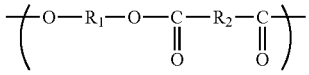

(2)

where at least one of $R_1$ and $R_2$ has an aromatic ring.

6. The method of producing a curable liquid developer according to claim 3, wherein the SP value of the vinyl ether compound is not more than 8.5, and a difference between the SP value of the binder resin and the SP value of the curable insulating liquid is at least 2.6.

7. The method of producing a curable liquid developer according to claim 3, wherein a weight-average molecular weight of the polyester resin is 5,000 to 30,000, and an acid value of the polyester resin is at least 5 mg KOH/g.

8. The method of producing a curable liquid developer according to claim 1, wherein the curable liquid developer contains a toner particle containing a pigment dispersing agent, and the pigment dispersion further contains the pigment dispersing agent.

9. A method of producing a curable liquid developer comprising a toner particle containing a pigment and a binder resin, a toner particle dispersing agent, and a curable insulating liquid, the method comprising:

a pigment dispersion step of preparing a pigment dispersion comprising the pigment, the binder resin, the toner particle dispersing agent, and a solvent;

a mixing step of mixing the pigment dispersion with the curable insulating liquid to obtain a mixture; and a distillative removal step of distillatively removing the solvent from the mixture to produce the curable liquid developer.

10. The method of producing a curable liquid developer according to claim 9, wherein the curable insulating liquid comprises a vinyl ether compound, and the binder resin comprises a polyester resin.

11. The method of producing a curable liquid developer according to claim 10, wherein the SP value of the vinyl ether compound is not more than 8.5, and a difference between the SP value of the binder resin and the SP value of the curable insulating liquid is at least 2.6.

12. The method of producing a curable liquid developer according to claim 9, wherein the toner particle further contains a pigment dispersing agent, and the pigment dispersion further contains the pigment dispersing agent.

* * * * *